US006997819B2

(12) United States Patent
Naylor et al.

(10) Patent No.: US 6,997,819 B2
(45) Date of Patent: Feb. 14, 2006

(54) GOLF CLUB AND METHOD OF MANUFACTURING

(75) Inventors: Robert F. Naylor, Scottsdale, AZ (US); David L. Petersen, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 6 days.

(21) Appl. No.: 10/766,400

(22) Filed: Jan. 27, 2004

(65) Prior Publication Data

US 2005/0164803 A1 Jul. 28, 2005

(51) Int. Cl.
*A63B 53/02* (2006.01)

(52) U.S. Cl. ..... 473/309; 473/310

(58) Field of Classification Search ..... 473/308–310
See application file for complete search history.

(56) References Cited

U.S. PATENT DOCUMENTS 1,844,812 A * 2/1932 Thorpe ..... 473/308
1,994,149 A * 3/1935 Root ..... 473/306
4,597,577 A 7/1986 Lamanna
5,624,330 A * 4/1997 Tsuchida ..... 473/308
5,771,552 A 6/1998 Karner et al.
6,352,482 B1 * 3/2002 Jacobson et al. ..... 473/310

FOREIGN PATENT DOCUMENTS

WO 2003/080191 2/2003

* cited by examiner

*Primary Examiner*—Stephen Blau
(74) *Attorney, Agent, or Firm*—Darrell F. Maquette; John D. Titus

(57) ABSTRACT

A golf club is manufactured according to a method in which a radially compliant crush sleeve is interposed between the shaft tip and hosel of the club head. The crush sleeve is fabricated from a strip of metal formed into a substantially cylindrical metallic band with a plurality of radially-extending dimples or corrugations that grip the shaft. The crush sleeve is retained either in an undercut region in the hosel bore, on a mandrel extending from the hosel, or on a pilot shaft at the tip of the golf club shaft. After the interface between the shaft and hosel is coated with an adhesive, the shaft is assembled to the hosel with the crush sleeve squeezed in between. The crush sleeve secures the shaft to the club head with sufficient rigidity to allow the adhesive to set while maintaining the appropriate axial and rotational alignment.

7 Claims, 5 Drawing Sheets

GOLF CLUB AND METHOD OF MANUFACTURING

BACKGROUND OF THE INVENTION

This invention relates generally to golf clubs and more particularly to the assembly of golf club heads to golf club shafts.

A critical step in the manufacture of golf clubs is the assembly of the club head to the club shaft. Typically, to achieve a suitably secure bond between the club head and the shaft, an epoxy adhesive is applied to the shaft and/or the hosel bore. The shaft is then inserted into the hosel bore and the adhesive on the joint is allowed to cure. Since the alignment between the longitudinal axis of the golf club shaft and the club head is critical, various methods and apparatus have been proposed for maintaining the alignment between the club shaft and the club head while the adhesive is curing.

U.S. Pat. No. 5,771,552 to Karner, et al. discloses an apparatus comprising a plurality of clamps used to hold the club head and shaft in alignment. A heat-activated epoxy is applied to the joint, which is thereafter heated by means of an inductive heating element. A separate cold air cooling member returns the golf club joint to an operator handleable temperature for speed of production. Disadvantages of the foregoing method include the requirement for specialized heat activated bonding agents and the necessity of a complicated fixture. U.S. Pat. No. 4,597,577 discloses a golf club assembly system in which the golf club shaft is retained in the hosel bore by means of a pin-and-slot fastener that may be used with or without a conventional adhesive. Disadvantages of the aforementioned assembly may include the cost of manufacturing the slot in the shaft tip as well as the need for a precisely located pin transversely mounted within the hosel bore.

In yet another prior art assembly method, the bottom of the hosel bore is designed to create an interference fit with the shaft tip. The friction between the shaft tip and the bottom of the hosel bore holds the shaft in place as the adhesive cures. Although this method provides excellent alignment between the club head and shaft without complicated alignment fixtures or expensive custom shaft arrangements, it does have one drawback. Normal manufacturing tolerances of +/−0.003 on the shaft and the hosel bore turn a nominal 0.001 inch interference fit into a theoretical fit of from 0.007 inch of interference to 0.005 inch of clearance. The statistical distribution about the minimum and maximum tolerances improves yield over the print tolerances, however, manufacturing tolerances do create a not-insignificant number of clubs that are rejected because either the interference is too great for the shaft to be assembled to the club or there is unacceptable clearance between the shaft and the hosel bore. Reducing the tolerances and/or selectively fitting maximum material shafts to minimum material bores and vice versa improves yield, however, there is a cost associated with these manufacturing techniques. What is needed then is a method of assembling a golf club shaft to a club head that provides an interference fit at the base of the hosel bore without the need to tightly control tolerances or selectively fit shafts to match hosel bores.

SUMMARY OF THE INVENTION

The present invention comprises a golf club and method of manufacturing in which a radially compliant member is interposed between the shaft tip and hosel. According to an illustrative embodiment, the radially compliant member comprises a radial crush sleeve. The radial crush sleeve comprises a substantially cylindrical metallic band with a plurality of radially extending dimples or corrugations that grip the shaft to the club head. In one illustrative embodiment, the radial crush sleeve is retained in an undercut region in the hosel bore and the shaft is inserted into the sleeve. In an alternative embodiment, the sleeve is retained against the shoulder of a pilot shaft region of the golf club shaft. The sleeve and shaft are then simultaneously inserted into the hosel bore. In a third alternative embodiment, the radial crush sleeve is retained on a mandrel extending from the hosel. The hollow golf club shaft is then inserted over the mandrel and sleeve. In each case, the radial crush sleeve secures the shaft to the club head with sufficient rigidity to allow an epoxy adhesive applied to the joint to cure while maintaining the appropriate axial and rotational alignment.

BRIEF DESCRIPTION OF THE DRAWING

The present invention will be better understood from a reading of the following detailed description, taken in conjunction with the accompanying drawing figures in which like references designate like elements, and in which.

DETAILED DESCRIPTION

Figure 1:
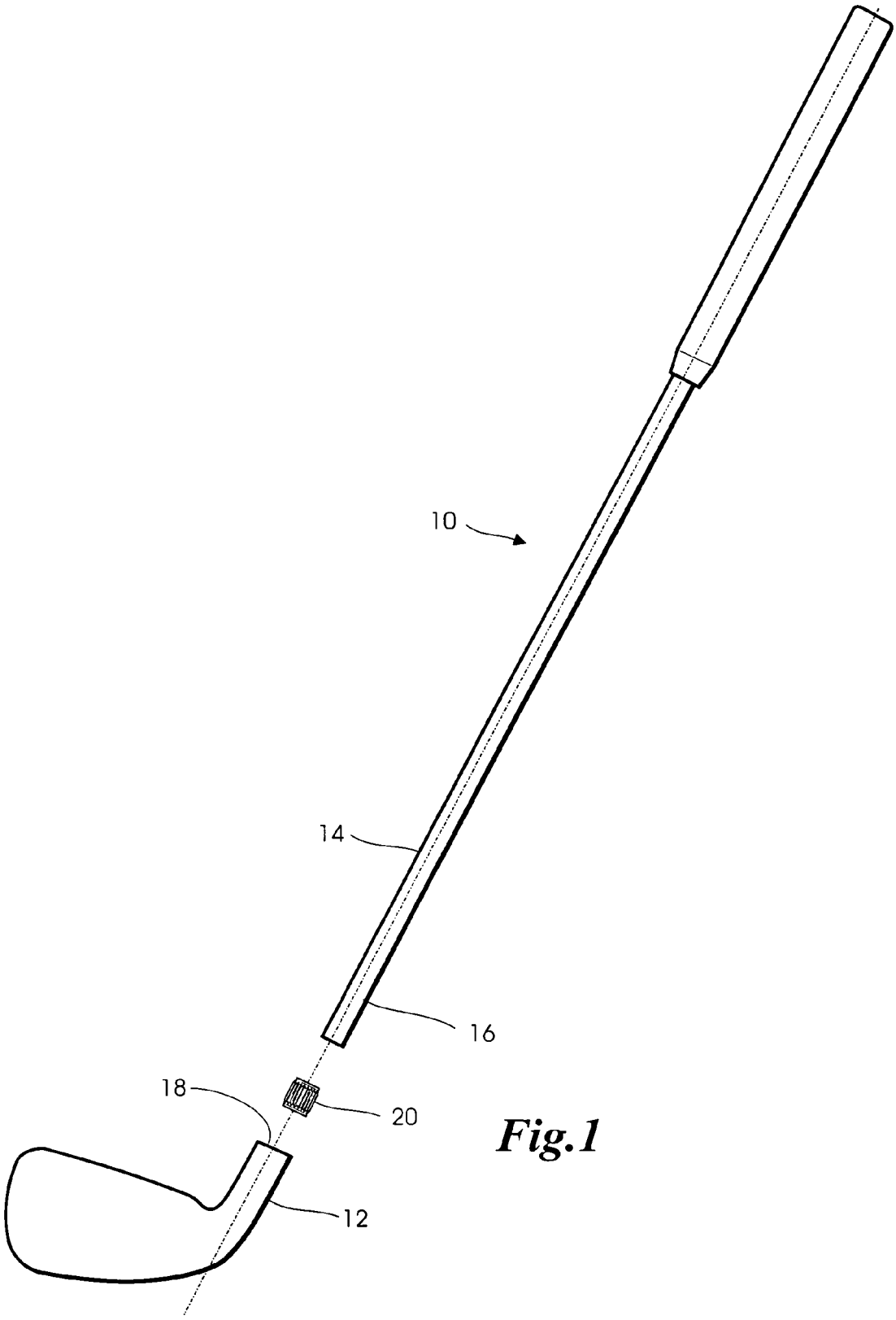
FIG. 1 is an exploded side view of a golf club incorporating features of the present invention.

The drawing figures are intended to illustrate the general manner of construction and are not necessarily to scale. In the description and in the drawing figures, specific illustrative examples are shown and herein described in detail. It should be understood, however, that the drawing figures and detailed description are not intended to limit the invention to the particular form disclosed but are merely illustrative and intended to teach one of ordinary skill how to make and/or use the invention claimed herein and for setting forth the best mode for carrying out the invention.

Figure 2:
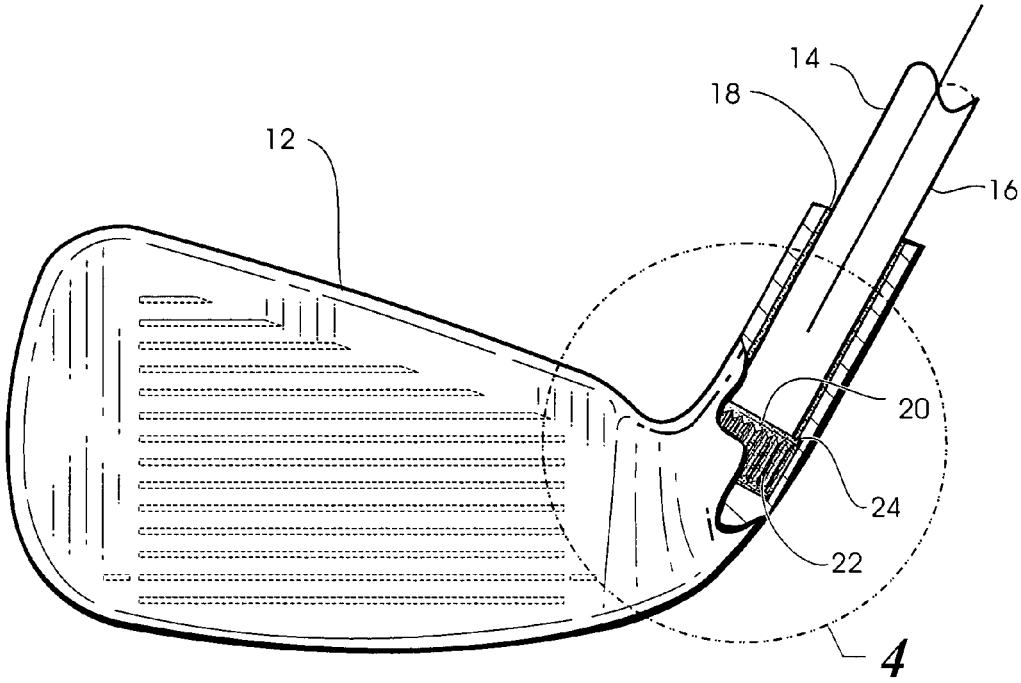
FIG. 2 is a partial cutaway view of a portion of the golf club of FIG. 1, assembled.
Figure 3:
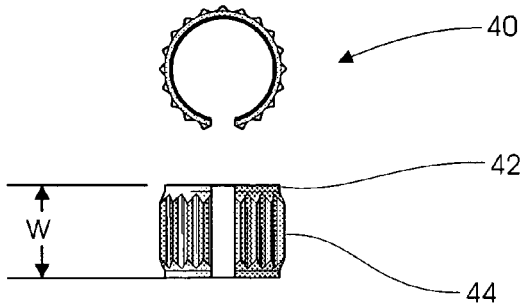
FIG. 3 is a top and side view of a radial crush sleeve in accordance with the present invention.

With reference to FIG. 1, a golf club 10 incorporating features of the present invention comprises a golf club head 12 and a golf club shaft 14. Golf club 10 is assembled by inserting the tip end 16 of golf club shaft 14 into the hosel bore 18 of golf club head 12. Prior to inserting tip end 16 into hosel bore 18, tip end 16 is coated with an adhesive, preferably an epoxy such as Hysol 10C Grey (not shown in FIG. 1). In order to maintain alignment between golf club shaft 14 and golf club head 12 while the adhesive cures, a radial crush sleeve 20 is interposed between tip end 16 of golf club shaft 14 and hosel bore 18. As shown more clearly in FIG. 2, radial crush sleeve 20 comprises a substantially cylindrical band 24 having a plurality of radially extending corrugations or dimples formed around the periphery of cylindrical band 24. Depending on the application, as shown in FIG. 2, the radially extending dimples may be in the form of dimples 22 that extend radially inward from cylindrical band 24, or as shown in FIG. 3 the radially extending dimples of crush sleeve 40, may be in the form of dimples 44 that extend radially outward from a cylindrical band 42.

Radial crush sleeve 20 is fabricated by cutting a strip of material, for example 0.006 inch thick stainless steel to the proper width "W", which in the illustrative embodiment is a nominal 0.375 inches. The strip of material is then passed between a pair of rolling dies that form the dimples with the appropriate pitch and height. The strip is then cut to a length equal to the appropriate circumference and rolled between a pair of rolling dies to form a cylinder. The cylinder has a gap between the ends to permit the radial crush sleeve to be compressed slightly for insertion into the bore. Accordingly, as used herein in connection with describing the radial crush sleeve as being "substantially cylindrical" the term substantially cylindrical is intended to include a cylindrical band with a gap in the circumference. In the illustrative embodiment of FIG. 2, dimples 26 have a nominal height of 0.025 inches and nominal pitch of 0.0984 inches. The nominal outside diameter of the radial crush sleeve is 0.375 inches. A preferred commercial source for the radial crush sleeve of the illustrative embodiment is USA Tolerance Rings, Inc. of West Trenton, N.J.

Figure 4:
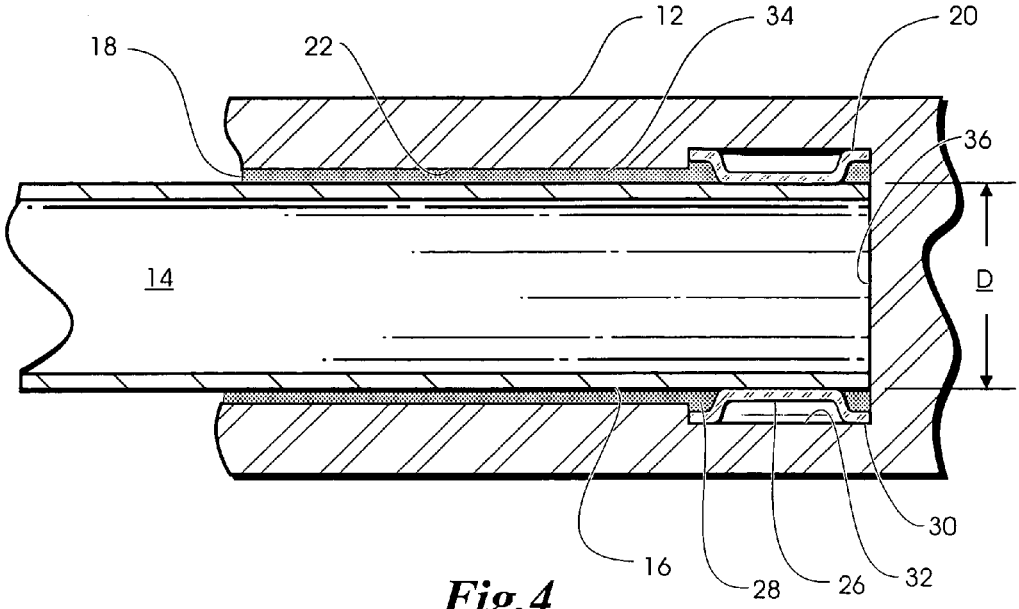
FIG. 4 is an enlarged cross-sectional view of the hosel portion of the golf club of FIG. 2.

With reference to FIG. 4, hosel bore 18 includes a cylindrical undercut region 28, which in the illustrative embodiment has a nominal inside diameter of 0.400 inches. Prior to assembly of shaft 14 to head 12, radial crush sleeve 20 is compressed and inserted into hosel bore 18 until it snaps into place with the outer surface 30 of radial crush sleeve 20 bearing against the inner surface 32 of undercut region 28. The tip end 16 of golf club shaft 14 is then coated with epoxy 34 and inserted into hosel bore 18 through radial crush sleeve 20 until it bottoms against the bottom surface 36 of hosel bore 18. In the illustrative embodiment, the nominal outside diameter "D" of tip end 16 is 0.360 inches. As noted hereinbefore, the nominal height of dimples 26 is 0.025 inches. Accordingly, when resting in undercut region 28 radial crush sleeve 20 provides a nominal interference of 0.010 inches between the tips of dimples 26 and the outside diameter of tip end 16. At 0.010 inches of interference a radial crush sleeve fabricated from 0.006 inch type 301 stainless steel provides an estimated insertion force of approximately 150 pounds and a minimum breakaway torque of approximately 15 inch pounds. As is evident from the foregoing, a nominal interference of 0.010 inch that produces an insertion force of only 150 pounds provides the ability to design a 0.010 inch nominal interference with tolerances on undercut region 28 and tip end 16 of +/−0.005 inches without the possibility of there being in excess of 150 pounds insertion force or less than a line-to-line fit.

In the illustrative embodiment, at a nominal interference of 0.010 inches, the dimples 26 of radial crush sleeve 20 are still bending within their elastic range. Accordingly, as used herein the term "radial crush sleeve" does not necessarily imply that radial crush sleeve 20 is distorted into the plastic region of the material, however, where greater insertion forces are desired, radial crush sleeves that are crushed into the plastic range of the material are feasible.

Figure 5:
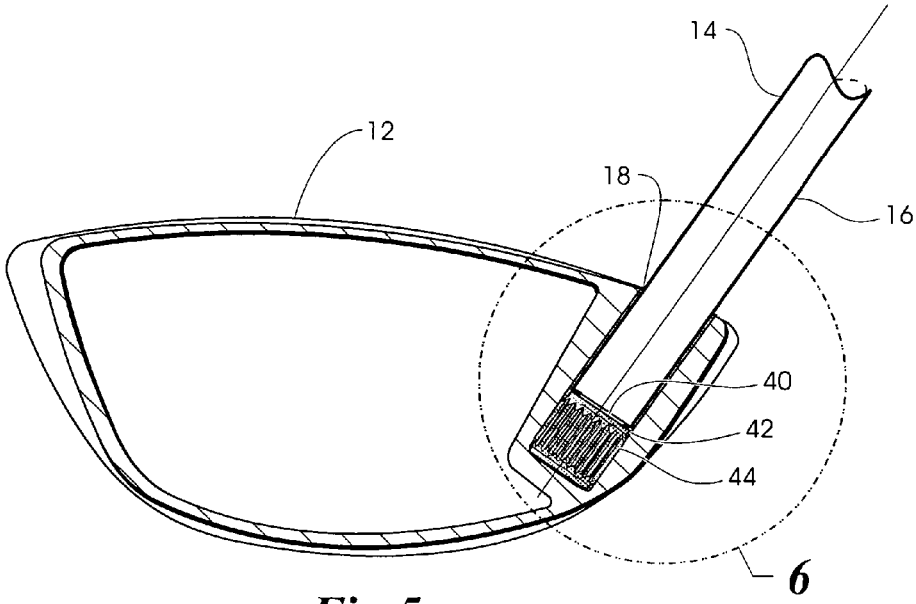
FIG. 5 is a partial cutaway view of a portion of an alternative embodiment of a golf club incorporating features of the present invention.
Figure 6:
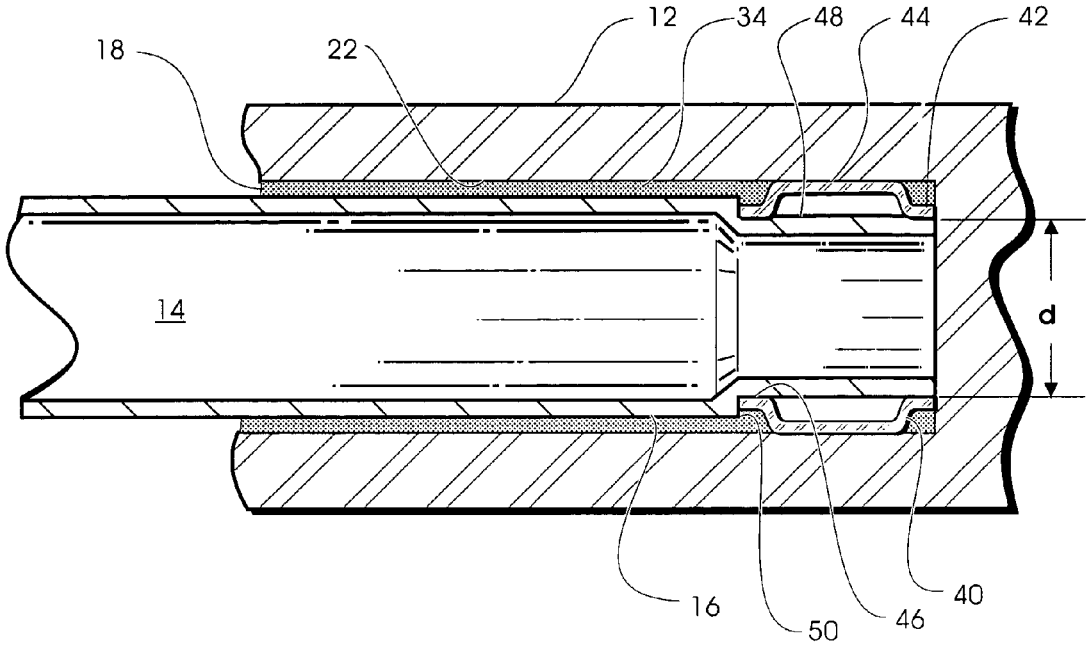
FIG. 6 is an enlarged cross-sectional view of the hosel portion of the golf club of FIG. 5.

With reference to FIGS. 5–6, in an alternative embodiment, a radial crush sleeve 40 comprises a substantially cylindrical band 42 having a plurality of dimples 44 that extend radially outward from the inner surface 46 of radial crush sleeve 40. Tip end 16 of golf club shaft 14 is formed with a pilot shaft 48 having a diameter "d" that is less than the nominal diameter of tip end 16 of golf club shaft 14. Golf club shaft 14 is assembled to golf club head 12 by placing radial crush sleeve 40 over pilot shaft 48 until it rests against shoulder 50 of golf club shaft 14. Epoxy 34 is then applied to the tip end 16 after which tip end 16, is inserted into hosel bore 18. Although there is an interference fit between dimples 44 and inner surface 22 of hosel bore 18, radial crush sleeve 40 is retained in place by shoulder 50 as it is inserted into hosel bore 18. The advantage of the illustrative embodiment of FIG. 4 is that it is not necessary to form an undercut in hosel bore 18, however, it requires cooperation between the golf club head manufacturer and the golf club shaft manufacturer to fabricate a shaft having the appropriate pilot shaft 48.

Figure 7:
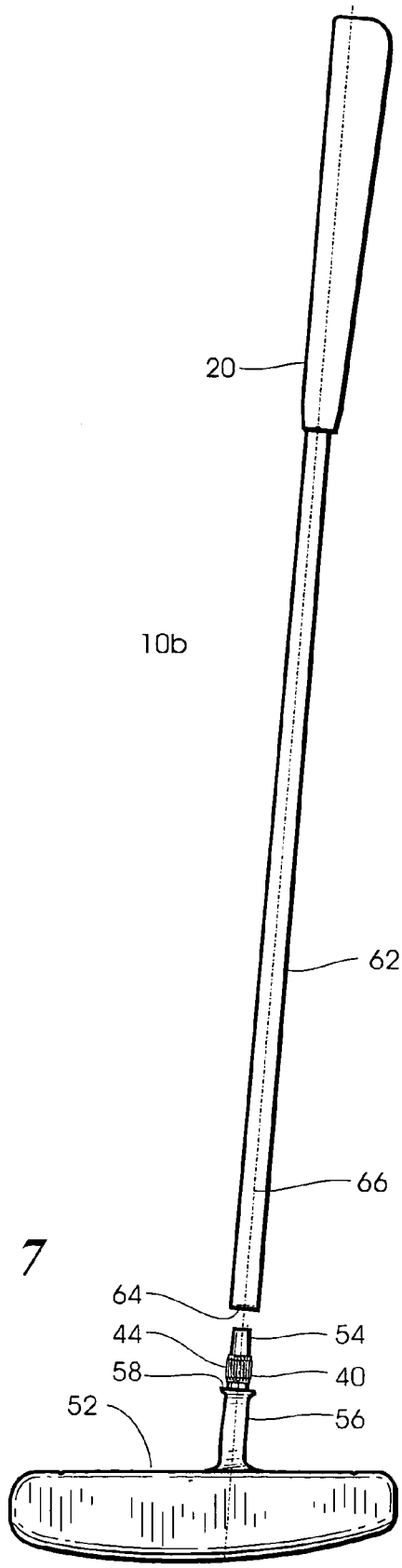
FIG. 7 is an exploded side view of another alternative embodiment of a golf club incorporating features of the present invention.

With reference to FIG. 7, in another alternative embodiment, a golf club head 52 is formed with a mandrel 54 extending upward from hosel 56. A radial crush sleeve 40 with outwardly extending dimples 44 is placed over mandrel 54 until it rests on shoulder 58 of hosel 56. Golf club shaft 62 comprises a hollow tube. Accordingly, golf club shaft 62 includes a bore 64 at tip end 66. (Alternatively, golf club shaft 62 is counterbored at the tip to provide the requisite tip bore). The club is assembled as before by coating the joint between shaft 66 and mandrel 54 with epoxy and forcing the shaft and hosel together.

As can be determined from the foregoing, the method of assembling a golf club interposing a radial crush sleeve between the shaft and hosel or as disclosed in the present invention affords substantial savings and costs associated with assembling the golf club shaft to the golf club head by providing a means of aligning the shaft to the head without the need for tightly controlled tolerances or elaborate assembly fixtures. Moreover, because there is no metal to metal contact directly between the golf club shaft and the golf club head, unpleasant vibration and stresses are not transmitted as readily from the golf club head to the golf club shaft, thereby resulting in a more pleasant and playable club.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club comprising:

a golf club head having a front surface adapted for impacting a golf ball, a back surface, a heel end and a toe end, said golf club head further comprising a hosel bore therein defining an inner surface for receiving a tip end of a golf club shaft;

a golf club shaft having a tip end and a butt end, the tip end of said golf club shaft being disposed within the hosel bore;

a radial crush sleeve disposed fully within the hosel bore radially outward of the tip end of the golf club shaft and radially inward of the inner surface of the hosel bore, said radial crush sleeve comprising a substantially cylindrical band portion having a plurality of radially extending dimples formed therein, said radial crush sleeve adapted to cause an interference fit between the tip end of the golf club shaft and the inner surface of the hosel bore; and a layer of adhesive disposed within the hosel bore for bonding the tip end of said golf club shaft to the hosel bore.

2. The golf club of claim 1, wherein:

the hosel bore comprises a major diameter and an undercut region, the undercut region having a diameter greater than the major diameter of the hosel bore.

3. The golf club of claim 2, wherein:

the diameter of the undercut region is at least 0.040 inches greater than the major diameter of the hosel bore.

4. The golf club of claim 2, wherein:

the radially extending dimples of said radial crush sleeve extend radially inward from the substantially cylindrical band portion of said radial crush sleeve.

5. A golf club comprising:

a golf club head having a front surface adapted for impacting a golf ball, a back surface, a heel end and a toe end, said golf club head further comprising a hosel;

a golf club shaft having a tip end and a butt end, the tip end of said golf club shaft being attached to the hosel of said golf club head by a joint formed between the golf club shaft and the hosel of the golf club head;

a radial crush sleeve interposed between the tip end of the golf club shaft and the hosel, said radial crush sleeve being completely concealed by the joint between the golf club shaft and the hosel of said golf club head, said radial crush sleeve further comprising a substantially cylindrical band with a plurality of radially extending dimples formed therein, said radial crush sleeve adapted to cause an interference fit between the tip end of the golf club shaft and the hosel.

6. The golf club of claim 5, wherein:

the hosel includes a bore defined by an inner surface;

the tip end of the golf club shaft has an outer surface; and the radial crush sleeve is interposed between the outer surface of the golf club shaft and the inner surface of the bore.

7. The golf club of claim 5, further comprising:

a layer of adhesive disposed between the hosel and the tip end of said golf club shaft for bonding the tip end of said golf club shaft to the hosel.

* * * * *